United States Patent [19]

Fuchs

[11] Patent Number: 5,056,414

[45] Date of Patent: Oct. 15, 1991

[54] LINEAR DRIVE WITH HYDRAULIC AMPLIFICATION

[75] Inventor: Peter Fuchs, Adlikon, Switzerland

[73] Assignee: Nova-Werke AG, Effretikon, Switzerland

[21] Appl. No.: 381,649

[22] PCT Filed: Sep. 27, 1988

[86] PCT No.: PCT/CH88/00174

§ 371 Date: Jun. 20, 1989

§ 102(e) Date: Jun. 20, 1989

[87] PCT Pub. No.: WO89/03939

PCT Pub. Date: May 5, 1989

[30] Foreign Application Priority Data

Oct. 20, 1987 [CH] Switzerland ..... 04101/87

[51] Int. Cl.[5] ..... F15B 9/12

[52] U.S. Cl. ..... 91/380; 91/382

[58] Field of Search ..... 91/380, 381, 382, 388

[56] References Cited

U.S. PATENT DOCUMENTS

| | | | |
|---|---|---|---|
| 1,942,189 | 1/1934 | Shepard . | |
| 2,984,217 | 5/1961 | Cline . | |
| 3,797,364 | 3/1974 | Schulze | 91/380 X |
| 3,913,449 | 10/1975 | Koch et al. . | |
| 4,116,112 | 9/1978 | Hampejs | 91/380 |

FOREIGN PATENT DOCUMENTS

| | | | |
|---|---|---|---|
| 0074922 | 1/1985 | European Pat. Off. . | |
| 3100725 | 7/1982 | Fed. Rep. of Germany . | |
| 676763 | 7/1979 | U.S.S.R. | 91/380 |

*Primary Examiner*—Edward K. Look
*Assistant Examiner*—George Kapsalas
*Attorney, Agent, or Firm*—Tarolli, Sundheim & Covell

[57] ABSTRACT

A linear drive comprises a hydraulic unit (1), a control valve (5) and an actuating drive (9) with an actuating member (7). These elements are interconnected by means of two inertia drive starters (4, 8), which results in a mechanically-induced return movement. The movement of the piston rod (15) of the hydraulic unit (1) is controlled in the actuating drive (9) by means of active elements (10, 35, 56) moved translationally in the direction of the longitudinal axis of the linear drive. The active elements (10, 35) and the actuating member (7) are connected without play in the axial direction but can counterrotate with respect to each other by means of a bearing (38). A lever (13) is arranged on the actuating member (7) and can be rotated together with the actuating member (7) about the axis (60). The lever (13) cooperates with a stop element (14) which can be adjusted by a rack (50) and which limits the rotation of the lever (13).

11 Claims, 5 Drawing Sheets

LINEAR DRIVE WITH HYDRAULIC AMPLIFICATION

BACKGROUND OF THE INVENTION

1. Technical Field

The invention relates to a linear drive with hydraulic amplification including a hydraulic cylinder, a piston connected with a first screw drive which forms a mechanical return, and a control valve for the pressure medium arranged along the longitudinal axis of the first screw drive. The control valve has a piston which is movable through a setting member. The setting member is connected at one end through a second screw drive with the first screw drive. A setting drive acts on the setting member. The linear drive can be used for the driving of a fuel injection pump or for the driving of the inlet and outlet valves of a combustion engine.

2. Background Art

From Swiss Patent 594,141 is known such a linear drive with hydraulic amplification in which the device shown is called a linear amplifier. This drive includes a hydraulic cylinder having a piston rod which transmits forces directly to the machine parts to be moved. In a piston of the hydraulic cylinder is attached a screw drive of which a nut is connected with the piston and a spindle with a control piston of a control valve. In one of the forms of execution shown, the spindle of the screw drive is designed in two parts by which a reduction of the rotating mass is provided. A second screw drive forms, at the same time, a security against overload. The control movements are produced by an electrical drive step-switch motor which sets the spindle of the screw drive in rotation. The rotating spindle is screwed into and out of the nut, and thus moves the control piston of the control valve supported on it. In this way, the inflow and outflow of oil to and from the hydraulic cylinder is regulated and the hydraulic piston is set in motion. The production of the rotary movement on the electric motor requires only slight energy, but nevertheless exerts great forces on the hydraulic piston. To compensate the axial movements between the rotor of the electric step motor and the spindle of the screw drive, a coupling must be connected between these elements to permit axial displacements of the spindle. This coupling has the disadvantage that the mass which must be set in motion by the motor is considerably increased. So that the exactness of the transmission of the switching movement from the motor to the spindle remains assured, the coupling must be designed as rigid as possible against torsion, which is associated with considerable difficulties. Through the rapid and frequent switchings, the coupling is under very strong load, which leads to a rapid wear and to loss of accuracy of the transmission of movement. In rapid drive processes, such as in the driving of fuel injection pumps and valves in combustion engines, requiring switching times in the range of fractions of a second electric step-switch motors cannot, in many cases, maintain the switching times. Improvements are possible through expensive technical measures, but lead to very expensive drives which still have the disadvantage of a short life.

The use of a linear drive with hydraulic amplification for the hydraulic driving of a fuel injection pump on a combustion engine is known from German Disclosure 3,100,725. In the linear drive is used a one-part spindle through which the drive is extremely prone to disturbance. When the hydraulic piston stops as a result of overload or using up the whole movement distance, the electric drive motor is overloaded and the spindle or the motor may be damaged. If the hydraulic piston stands still, the control piston of the control valve can be brought into another switching position only by means of the electric drive motor or by rotation of the spindle. An automatic setting back into the zero position, for example, is not possible. This arrangement is especially unsuitable in the case of lifting movements of the hydraulic piston against a solid stop, since the control drive is subject to intolerable loads.

SUMMARY OF THE INVENTION

The present invention addresses the problem of providing a linear drive with hydraulic amplification in which the movement distances of the control elements are as short as possible. No coupling with axial compensation is necessary between a setting drive and a spindle. Setting gears with long life and very short switching intervals can be used. A hydraulic piston can be run against solid stops. The drive also makes possible a mechanical limitation of the upper and lower holding positions of the hydraulic piston without electric position measurement.

This problem is solved, according to the invention, by the fact that the setting drive has an active element with translational movement. This active element is connected with a setting member and can be pushed along with it in the axial direction of the setting member. The setting member is rotatable around this axis independently of the setting drive. A lever is fastened to the setting member and is rotatable with it around the axis. On the housing of the linear drive is arranged an adjustable stop element in the rotation portion of the lever.

In this linear drive according to the invention, by the setting drive or by its translationally moved active element, a force acting in the axial direction of the linear drive which acts on the setting member is produced. As a result of this force, the spindle of the second screw drive rotates, and thus causes a displacement of the setting member in the longitudinal axis, and at the same time a displacement of the control valve piston. The control valve piston frees the flow of pressurized oil into the hydraulic piston by which the latter is also set in motion axially. The axial movement of the hydraulic piston causes a rotary movement of the first screw drive. This rotary movement of the first screw drive is transmitted to the second screw drive. Since the setting member is rotatable around its longitudinal axis independent of the setting drive, the setting member rotates with the spindle of the first screw drive as long as the axial force produced by the setting drive is maintained. As soon as this axial force is removed, the rotation of the first screw drive effects, through the second screw drive, a return of the setting member and thus the control valve body into the original position. In this way, the hydraulic piston automatically remains in its position.

In another embodiment of the invention, the second screw drive is a ball threaded drive in which the nut of this ball threaded drive is supported rotatable in the drive housing. The nut is connected rigidly at one end with the spindle of the first screw drive and receives at the other end the end of the setting member by the ball threaded spindle arranged on this end. The ball threaded drive makes possible an especially easy running translational and rotary movement of the setting member. In this way, only very slight axial forces need be used by the setting drive in the axial direction of the setting gear to produce a rotary movement of the spindle of second screw drive.

One preferred form of execution of the invention is distinguished by the fact that a double-action piston cylinder unit is arranged on the setting member as the setting drive. This unit produces axial movements of the setting member. Because of the slight axial forces which are needed for the displacement of the setting member, this piston cylinder unit can be designed very small. This makes possible extremely short switching intervals, and despite what is known for such control valves, long life values are obtained. The turning on of the double-action piston cylinder unit takes place in a known manner by an electrohydraulic control valve which receives control pulses from known devices.

Another improvement of the linear drive can be obtained from the fact that the active element of the setting drive is a cam shaft, and that the end of the setting member opposite the screw drive lies at least partly against the control surface of the cam shaft. A spring is also arranged on the setting member, which acts in the axial direction against the linear movement produced by the screwing in of the second screw drive. The spring is linked at one end to the setting member and at the other end to a solid stop. Since the axial switching distance of the control valve piston and the forces necessary for this axial movement are relatively small, the cam shaft may be small and designed with less mass. By using the cam shaft with the single active element, the switching function of the control valve piston is mechanically provided by the shape of the cam and the speed of the rotary movement of the cam shaft. If an additional switching element is installed between the cam shaft and the setting member, the cam shaft along with the double action piston cylinder unit on the setting element as the setting drive act as an emergency drive or may be used as a single setting drive. This emergency drive is switched on whenever the electric control of the piston unit cylinder fails. The spring arranged on the setting member is so dimensioned that the setting member, upon removal of axial force, is mechanically run back. With this, the control valve piston is so displaced that the hydraulic piston moves back while the spindles of the first and second screw drive turn in the same direction. From this moment on, the second screw drive produces an axial movement of the setting member by which the control valve piston is brought back into its neutral position. In this way, the hydraulic piston is also stopped and held in its position.

In another embodiment of the invention, an additional switching and control element movable transverse to the axis is installed between the cam shaft and the end of the setting element. This switching element lies by a running roller on the control surface of the cam shaft. This control element makes possible, on one hand, the switching toward and away from the cam shaft and, on the other hand, the modulation of the control movement which is produced by the cam against the cam shaft. For this purpose, the switching and control element is movable transverse to the axis and has a portion with increasing and decreasing thickness. By moving the switching element transverse to the axis, the running roller and thus its point of contact against the cam is also moved. This results in a change of the axial movement produced by the cam, that is, modulation.

Another preferred form of execution of the invention is distinguished by the fact that the setting member and the hydraulic unit are each connected with a measuring device for a determination of the position in the axial direction. These measuring devices make possible a checking of the momentary operating condition and an adapting to any requirements through the setting device.

An improvement of the linear drive may be obtained by arranging parallel to the control element a mechanically turned-on control slide. Two pressure medium outlets of this slide discharge into the cylinder bore and the mechanical switching element of the control slide discharges into the cylinder bore and impacts the piston of the piston-cylinder unit with pressure medium. The mechanical switching element of this control slide cooperates with the control element and the cam shaft. This form of execution is still more compact in construction, and makes possible the saving of construction length. Also, the mass which must be moved by the cam is further reduced. This leads to an additional and considerable reduction of the cam forces.

Another improvement of the movement cycle of the stop element in the linear drive can be effected by the fact that the stop element can be moved through a toothed rack. On the toothed rack is arranged at least one spring-weighted braking means. The braking means blocks the toothed rack in the position in which the lever lies against the stop element. The braking means is connected by a piston and its piston chamber with the pressure medium bore to the cylinder bore.

Other preferred forms of execution of the invention are the use of the linear drive according to the invention for driving fuel injection pumps or inlet and outlet valves on combustion engines. In these uses, very short switching times and, at the same time, extremely long life of the device are required. In case of failure of the electric control, mechanical emergency controls are advantageous and which are provided in the linear drive according to the invention. The control valve and the hydraulic piston are to be adapted in a known manner to the requirements of use. The linear drive according to the invention finds other uses in machines and drives in which drives, already described as state of the art according to Swiss Patent 594,141, are used. The advantages described can also be obtained in these other uses.

BRIEF DESCRIPTION OF THE DRAWINGS

The invention will be explained in detail below, in examples with reference to the attached drawings:

FIG. 3 shows a simplified longitudinal section through an injection pump of a heat powered machine with a linear drive built on;

DESCRIPTION OF A PREFERRED EMBODIMENT

Figure 1:
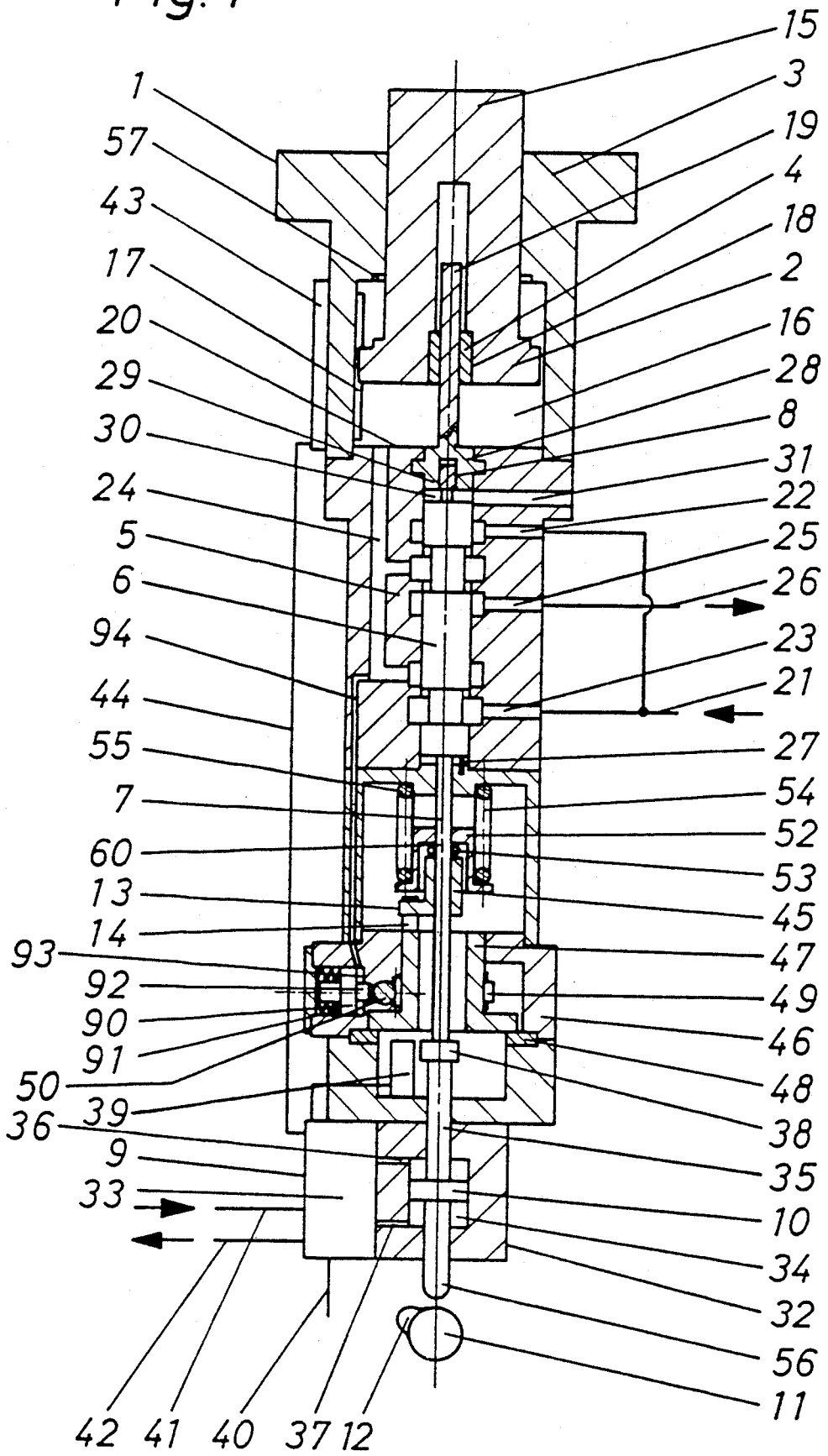
FIG. 1 shows a longitudinal section through a linear drive with hydraulic amplification and a setting drive, in simplified representation.

The linear drive shown in FIG. 1 includes a hydraulic unit 1 with a piston 2 and a cylinder 3. A piston rod 15 is led out of the hydraulic cylinder 3 and cooperates with the machine element to be moved. On the wall of a cylinder bore 16 is arranged a guard 17 against twisting which guides the piston 2 in the axial direction and prevents its rotation around the axis. In the center of the hydraulic piston 2 is arranged a first screw drive 4 which includes a nut 18 and a spindle 19. The nut 18 is fastened and secured against rotation in the piston 2.

Connected to the hydraulic cylinder 3 is a control valve 5, as is known. An end surface 20 of the control valve 5 forms, in the example shown, the closing flange of the cylinder bore 16 of the cylinder 3. In the housing of the control valve 5 is arranged a control piston 6 movable in the axial direction and having ring grooves and control edges. An inlet line 21 is connected with a source of pressurized oil, not shown, and directs pressurized oil through bores 22, 23 and into the control valve 5. From there, the pressurized oil is directed according to the position of the control piston 6 and through a bore 24 into a pressure chamber formed by the cylinder bore 16 of the hydraulic unit 1. Through a bore 25 and an outlet 26, and with the right position of the control piston 6, the pressurized medium can flow out of the cylinder bore 16 through the bore 24. The control piston 6 is supported on a setting member 7 which is guided through the center of the control piston 6. This setting member 7 can rotate around its longitudinal axis, but the control piston 6 is secured against rotation around its axis by a rotation guard 27. In the axial direction, the control piston 6 is supported, free of play, on the setting member 7. On the end of the control valve 5 toward the hydraulic unit 1 is supported a nut 28 of a ball threaded gear, rotatable and secured against axial movement. Such ball threaded gears are also called ball screw and nut mechanisms. The structure and operation of ball screw and nut mechanisms are known and, therefore, are not described. The nut 28 is a component of a second screw drive 8 and is connected rigidly with the spindle 19 of the first screw drive 4. A ball threaded spindle 29 belonging to the second screw drive 8 is fastened to the upper end of the setting member 7 and is connected rigidly with it. A space 30 between the control piston 6 and the nut 28 communicates with a bore 31 which leads to a leakage line, not shown. At the other end of the control piston 6, the setting member 7 is lengthened and cooperates with an active element of a setting drive 9.

The setting drive 9 includes, in the example shown, a double-action piston cylinder unit 32 and an electrohydraulic control element 33. The unit 32 has a cylinder bore 34, a piston 10 connected with a piston rod 35, and bores 36, 37 for the entrance and exit of pressurized medium. The piston rod 35 is connected at the upper end, free of play, through a bearing 38 with the setting member 7 so that the setting member 7 can rotate around the longitudinal axis independent of the piston rod 35. The piston rod 35 forms an active element of the setting drive 9. Besides the piston rod 35 is arranged a measuring sensor 39. The measuring sensor 39 determines the position in the axial direction of the piston rod 35, forms an active element of the setting member 7, and transmits this to the control element 33. Other control pulses are fed to the control element 33 through a control line 40. Through pressure lines 41, 42 is carried in and out the oil needed for the movement of the piston 10. Another measuring sensor 43 is located on the hydraulic unit 1 by means of which the position of the hydraulic piston 2 is determined. The corresponding measurement values are fed through a line 44 to the control element 33.

Between the setting drive 9 and the control valve 5, an element 45 with a lever 13 extending radially is fastened to the setting member 7. Below this element 45, a bushing 47 rotatable around the axis is supported in a housing 46. A stop element 14 is connected to the bushing 47 which lies on a bearing 48, and is provided on the circumference with a cogwheel 49 which engages a toothed rack 50. The rack 50 is driven by a control unit 51 shown in FIG. 2.

Above the element 45 is arranged a spring guide cup 52 which is placed on a bearing 53 so that it does not rotate around the longitudinal axis of the setting member 7. On this spring guide cup 52 is arranged a pressure spring 54 which lies at one end against the cup 52 and at the other end against solid stops 55 of the housing. So long as no axial pressure acts on the setting member 7, the spring 54 pushes away the setting member 7 and with it the control piston 6 in the axial direction of the hydraulic unit 1.

As an additional active element of the setting drive 9, a cam shaft 11 with a cam 12 is arranged below the piston cylinder unit 32. The piston rod 35 is guided out into this portion from the piston cylinder unit 32, and thus forms an extended end of the setting member 7. If the cam shaft 11 is actuated, that is, rotated around its axis, an end 56 of the piston rod 35 lies against the control surface of the cam 12 and is deflected by this into the axial direction. With this, the setting member 7 and the control piston 6 are also pushed upward, and as a result a lifting movement of the hydraulic piston 2 is begun.

The manner of operation of the linear drive may be described from FIG. 1 as follows. The control piston 6, the hydraulic piston 2, and the piston rod 15 are in the lower starting position of a lifting movement. Through the control line 40, the control element 33 receives a starting signal for the beginning of a movement. The electrohydraulic control element 33 opens the inflow of pressurized oil to the bore 37 and thus to the lower part of the cylinder bore 34 in the piston cylinder unit 32. The axial force acting on the piston 10 and the piston rod 35 is in the direction of the hydraulic unit 1. This axial force is transmitted through the bearing 38 to the setting member 7, and thus acts on the spindle 29 of the ball threaded gear 8. The axial force applied is converted here, at least partly, to a rotation moment acting on the setting member 7. As a result of the force conditions prevailing in the ball threaded gear 8, the spindle 29 is screwed into the nut 28 and follows the translational movement produced by the piston 10. Since the control valve piston 6 is supported free of play on the setting member 7, the latter is also pushed in the direction of the hydraulic unit 1 and thus frees the inflow of pressurized oil from the bores 22, 23 to the bore 24, and thus to the cylinder bore 16. The oil under pressure acts on the hydraulic piston 2 to effect a lifting movement of the piston rod 15. This movement in the axial direction is followed also by the nut 18 of the first screw drive 4. The nut 18 of the first screw drive 4 is fastened in the piston 2. The spindle 19, solidly supported in the axial direction, is thus set in rotation and rotates the nut 28 around the longitudinal axis. The rises of the two spindles 19, 29 are in opposite directions so that the hydraulic piston 2 and the control piston 6 move the freely rotating spindles 19, 29 in opposite directions. During the lifting movement of the piston 2, however, the active element or piston 10 of the setting drive 9 continues to press against the setting member 7 and thus on the spindle 29 in the nut 28. The force is so great that the spindle 29 cannot turn back. The control piston 6 also remains in the deflected position. The spindle 29 of the ball threaded gear 8 thus turns at the same speed as the nut 28 around the longitudinal axis. This is made possible by the support of the setting member 7 on the control piston and the bearing 38 at the end of the piston rod 35.

In the example shown, a piston acting in one direction is used as the hydraulic piston 2. At the upper surface of the piston and at the upper end surface of the cylinder bore 16, there is a damping device 57. The damping device 57 includes a displacing piston (not shown) which is formed by a shoulder on the lower end of the piston 2 and an oil-filled chamber (not shown) at the upper end surface of the cylinder bore 16. The oil-filled chamber cooperates with the shoulder to provide damping. Just before the piston rod 15 completely runs out, the damping device 57 goes into action by the shoulder running into the oil-filled chamber and causes, through the expulsion of the enclosed oil, a rapid braking and damping of the piston 2. When the piston 2 reaches the portion of the upper dead point of the lifting movement, the pressure exerted on the piston 10 of the setting drive 9 is broken down so that the pressure impact is interrupted and the bore 37 is connected with the return flow line 42. As a result of a residual rotary movement of the spindle 19 with the nut 28 and/or because of the biasing force of the spring 54 which acts on the setting member 7, the control piston 6 is first set in its neutral position and then into the return position. With this, the bore 24 is connected with the bore 25, and the oil in the cylinder bore 16 can flow out into the outlet line 26. In the example shown, the piston rod 15 cooperates a pneumatic spring, not shown in FIG. 1, but which can be seen in FIG. 3. This pneumatic spring presses the piston rod 15 and with it the piston 2 back into the cylinder 3, that is, toward the portion of the lower dead point. Through this axial movement, the spindle 19 is again rotated while the pressure exerted by the spring 54 and the axial force acting on the setting member 7 are so dimensioned that the spindle 29 turns in the same direction with the nut 28. In this way, it is assured that the control piston 6 remains in the position in which the return is open. At the same time with the setting member 7, the element 45 with the lever 13 joined solidly with the setting member 7 also rotates around the axis of the setting member. This movement continues until the lever 13 strikes against the stop element 14, and thus the rotating movement of the setting member 7 is interrupted. As soon as the setting member 7 can no longer turn synchronous with the nut 28 of the ball threaded gear 8, the spindle 29 is screwed into the nut 28 and thus pushes the control piston 6 into its original position. In the original position of the control piston 6, both the inlet line 21 and the outlet line 26 are separated from the bore 24, and the piston 2 stands still since no inflow or outflow of pressurized fluid from the cylinder bore 16 is any longer possible. Since the piston 2, unlike the lifting movement, returns relatively slowly and under slight force, the lever 13 and the stop element 14 may be relatively simple and rigid. As a result of the direct mechanical backcoupling through the spindle 19 and the setting member 7, the positioning of the piston 2 is very exact and may be repeated as desired. In the example shown, the lift of the piston 2 or the piston rod 15 is measured from the upper dead point, while the lower dead point of the piston is variable. In this way, there is provided for the total lift of the piston 2 a purely volumetric measurement which is dependent neither on a time nor other error-prone measuring means.

Figure 2:
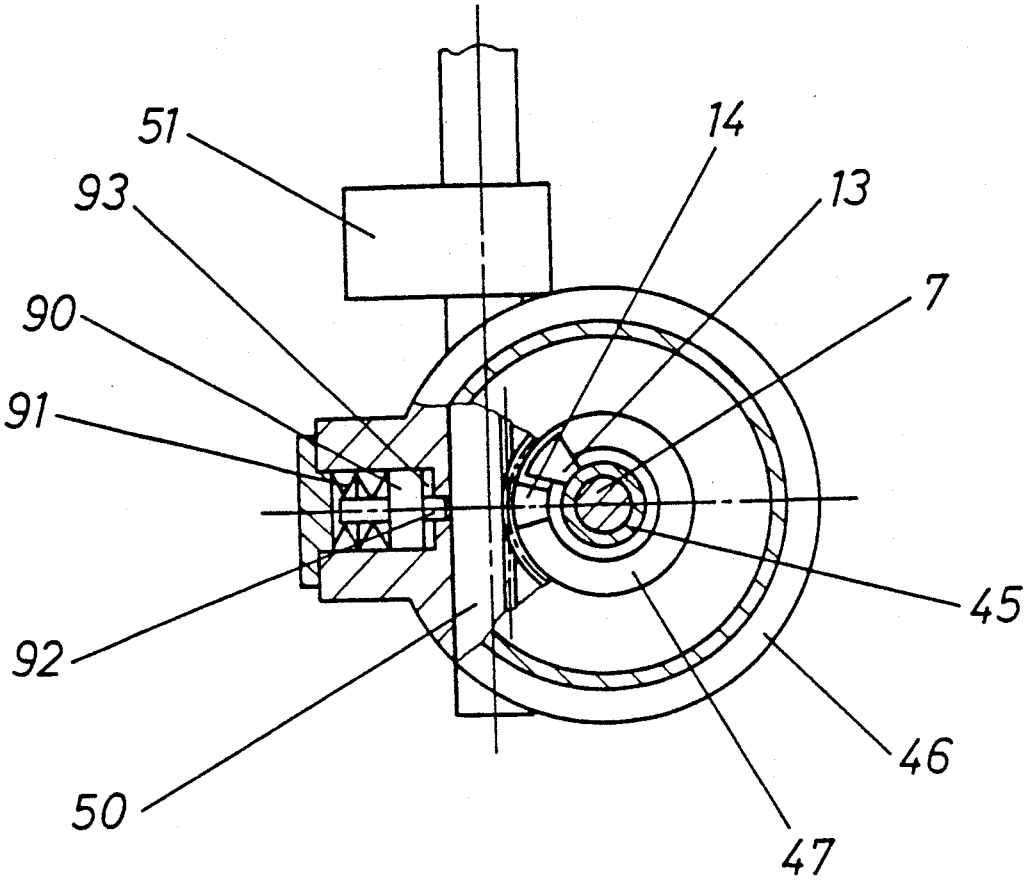
FIG. 2 shows a partial section, transverse to the longitudinal axis of the setting drive of FIG. 1, in the vicinity of a stop element.

The stop element 14 is arranged on the bushing 47 which is rotatable around the longitudinal axis of the setting member 7. For this purpose, the bushing 47 is supported in the housing 47 and lies on a bearing 48. On the circumference of the bushing 47 is a toothed crown which engages a toothed rack 50. As FIG. 2 shows, this rack is driven through a control unit 51 supported on the housing 46. The control unit 51 contains a corresponding known drive. The control unit 51 receives the corresponding control signals from a central control device, not shown. On the back of the rack 50 is arranged a braking means 92 with which the movement of the rack 50 can be blocked. The braking means 92 is pressed by a plate spring 91 against the rack 50 so that the control unit 51, which has limited pushing power, cannot push the rack 50 while the lever 13 is applied against the stop element 14. As soon as the control piston 6 frees the pressure in the bore 24, a piston chamber 93 is also impacted with pressure through a bore 94. This is so that a piston 90 can lift off the braking pin from the rack 50, and so that the control unit 51 can set, until the back stroke, the new position of the stop element 14. Normally, the rise of the spindle 19 and the stroke of the piston 2 are so dimensioned that the stop element 14 is adjustable in a range of one rotation around the axis. With greater stroke movements or with other chosen conversion ratios in the screw drive 4, the bushing 47 with the aid of the control unit 51 may go through a fraction of or several additional rotations to be fixed again in the desired position.

The measuring sensors 43, 39, shown in FIG. 1, are provided for the monitoring of the correct position of the hydraulic piston 2 and of the piston 10 acting as a translational active element in the setting drive 9. These sensors are provided for the optimization and additional refinement of the functional cycle of the setting drive. In case of an emergency, the drive shown here may also be operated in case of failure of the electrical measurement and control devices if, as shown in FIG. 1, a cam shaft 11 with a cam 12 is built in for control. Here, the cam 12 acts by the control surface on the end 56 of the piston rod 35 which forms an extension of the setting member 7. The cam 12 deflects the setting member 7 upward, and the force acts on the spindle 29 of the ball threaded gear 8. This effects a screwing-in of the setting member 7, and thus an adjustment of the control piston 6 into the position in which pressurized oil is introduced into the hydraulic unit 1. The remaining cycle of operation corresponds to the steps described above. As soon as the cam 12 no longer lies on the end 56 of the piston rod 35, that is, releases its movement again, the pressure spring 54 effects, as already described above, the setting back of the control piston 6 and thus the back stroke of the hydraulic piston 2. This work cycle can be repeated as often as desired, while the adjusting of the stroke is also possible mechanically through the control unit 51.

Figure 3:
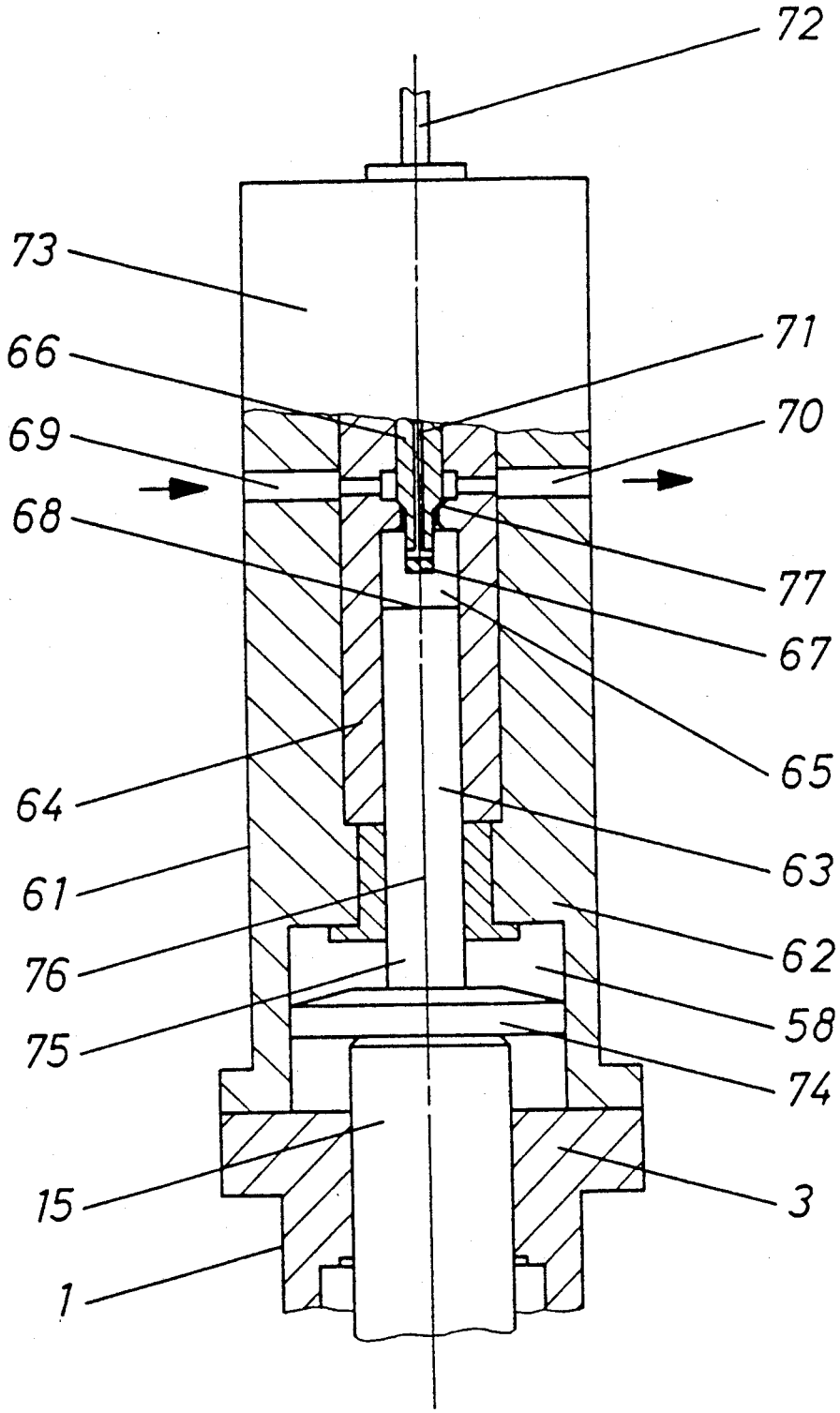

In FIG. 3 is shown one use for the linear drive according to the invention shown in FIG. 1 in combination with a fuel injection pump 61 for a heat-powered machine. The fuel injection pump 61 includes a pump piston 63 which is guided in a cylinder bushing 64. The cylinder bushing 64, in turn, is arranged in a housing 62 of the injection pump 61 and is supported there.

A lower end 75 of the pump piston 63 is connected with a piston 74 which is a component of the pneumatic spring 58. This pneumatic spring 58 has known compressed air feed lines and pressure limiting device, not shown. To the piston 74 of the compressed air spring 58 is connected the piston rod 15 of the hydraulic unit 1 of the linear drive. The housing 62 of the injection pump 61 is connected solidly and rigidly with the cylinder 3 of the hydraulic unit 1. In this way, it is assured that movement of the piston rod 15 is transmitted without error to the piston 74 and thus to the pump piston 63 of the injection pump 61.

The pump piston 63 of the injection pump 61 is movable in the direction of the longitudinal axis 76 of the injection pump, while an end surface 68 limits a cylinder chamber 65. A lower end 67 of a valve body 66 projects into this cylinder chamber 65. The valve body 66 has a valve seat 77 through which the cylinder chamber 65 is connected with an inlet bore 69 and an outlet bore 70. In an upper part 73 of the injection pump 61 are again known devices, but not shown, which are provided for the control and movement of the valve body 66. In the center of the valve body 66 is arranged a bore 71 through which pressurized oil is directed from the cylinder chamber 65 to a pressure line 72. This pressure line 72 is connected with an injection nozzle of an internal combustion engine, and feeds fuel under high pressure to the latter. The amount of fuel supplied per work stroke of the pump piston 63, and ejected into the pressure line 72, is measured volumetrically. At the upper dead point of the pump piston 63, the end surface 68 of the pump piston 63 strikes against the lower end 67 of the valve body 66, and holds the valve seat 77 open in this position. The position of the upper dead point is thus exactly determined and remains the same in all phases of operation. The position of the lower dead point of the pump piston 63 is variable according to the size of the desired fuel injection, and namely with the aid of the manner of functioning described for FIG. 1 of the linear drive according to the invention.

Figure 4:
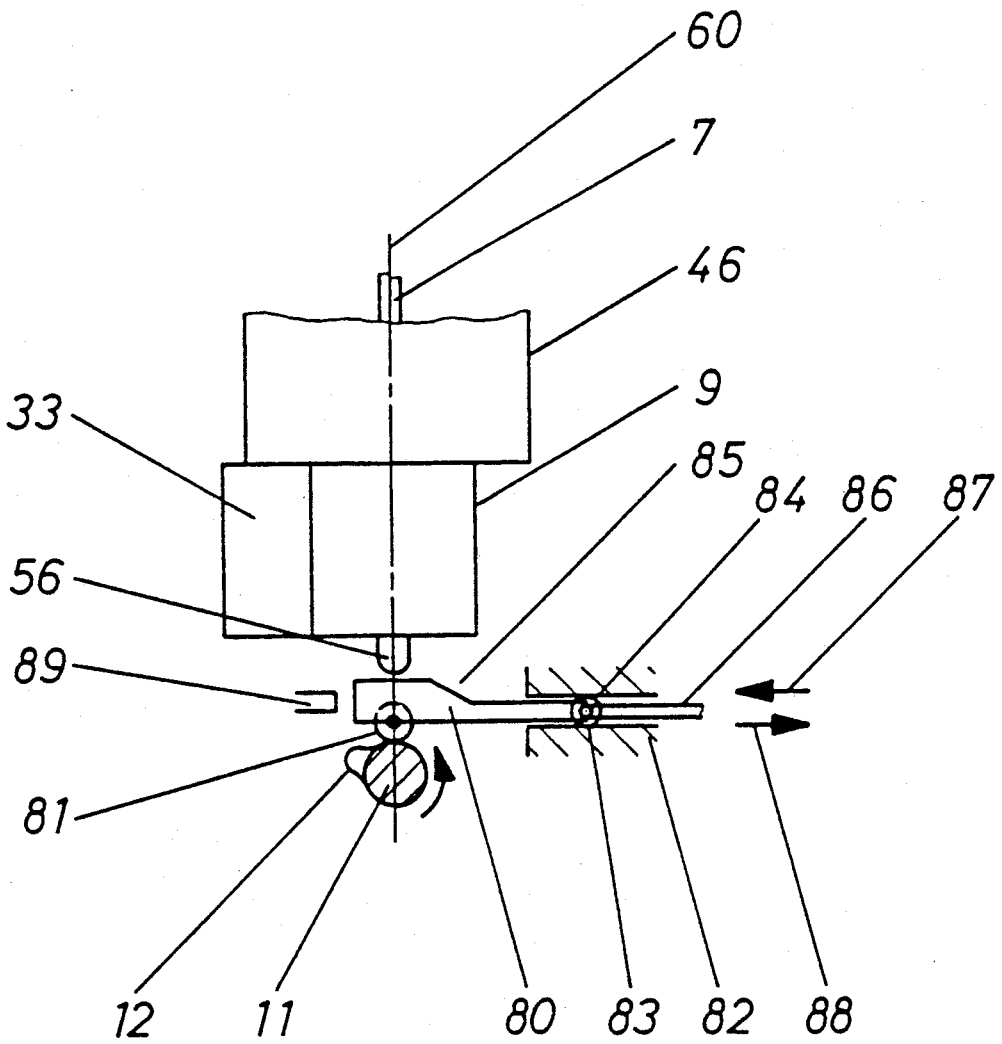
FIG. 4 shows an end portion of the linear drive of FIG. 1, with an additional control element between a cam shaft and a setting member, in simplified representation.

In FIG. 4 is shown the device by which the cam shaft 11 used as an active element is switched to the setting drive, and the lifting movement of the cam 12 can be controlled. For this purpose, a control element 80 is connected between the cam 12 of the cam shaft 11 and the end 56 of the setting member 7. The control element 80 has a running roller 81 which lies on the control surface of the cam shaft 11 or the cam 12. On an opposite sliding surface 85 of the control element 80 lies the end 56 of the setting member 7. The control element 80 can swing around a turning point 84 and is supported at this turning point 84 by a roller 83 in a bearing 82. By means of a rod 86, the control element 80 can be moved transverse to the axis 60 of the setting member. In the position shown, the control element 80 is pushed completely into the active position, and the deflection movement of the cam 12 on the cam shaft 11 acts to its full extent on the setting member 7. If the control element 80 is moved in the direction of the arrow 87, the oblique part of the surface 85 acts so that the cam shaft, with element 80 fully deflected, is uncoupled from the end 56 of the setting member 7. If the control element 80 is not completely uncoupled or moves in one of the directions of arrows 87 and 88 during the lifting process of the piston 2 in the hydraulic unit 1, a modulation of the piston movement is provided since the control piston 6 reacts at once to the axial movements of the setting member 7. If the roller 81 lies on the base circle of the cam 12, then an earlier lift movement can be produced, for example, by a movement of the control element 80 in the direction of the arrow 88, that is in the example shown, against the direction of the cam rotation. This advanced lift movement can be interrupted by sudden movement of the control element 80 in the direction of the arrow 87 during the course of movement. With this, the roller 81 with the control element 80 is moved so far that it rests again on the base circle or a desired lower point on the cam shaft 11. An adjustable stop 89 is provided for the exact determination of the main stroke movement. The control element 80 is run against the stop 89, and the cam 12 can carry out through the roller 81 the main stroke or residual stroke movement. With the use of a linear drive with this additional device on a fuel injection pump 61, the movement cycle described produces a course of injection with pre-injection, namely by mechanical control.

Modulations of the lift movement of the piston 2 of the hydraulic unit 1 can also be obtained, with the cam shaft 11 not present or not in active connection, by actuation of other active elements of the setting drive 9. Thus, for this purpose, the piston 10 shown in FIG. 1 can describe additional movements in the direction of the axis 60 of the setting member, and thus effect modulation movements of the control piston 6. The corresponding control commands are fed to the setting drive 9 through the electrohydraulic control elements 33 which, in turn, are controlled by corresponding control of position. It is apparent that the device according to the invention which is shown allows modulation of movement in a wide range. Nevertheless, the lift movement of the piston 2, as well as its lower dead point, can always be exactly determined and positioned.

Figure 5:
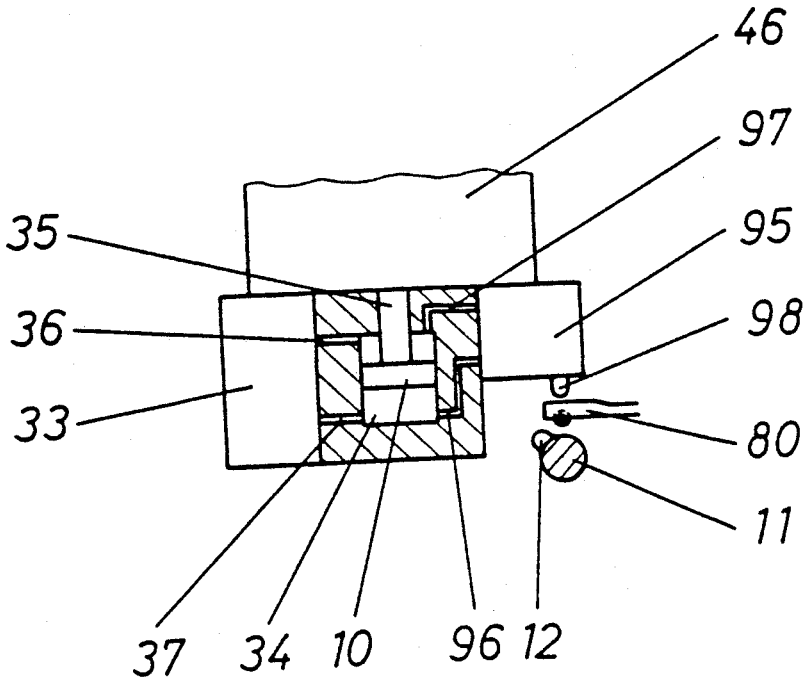
FIG. 5 shows a lower end portion of the linear drive, with a partial section and an additional control element.

According to FIG. 5, an additional hydraulic control slide 95 is parallel to the electrohydraulic control element 33. The control piston of this control slide 95 is provided with a switching element 98 which cooperates with the control element 80 and the cam shaft 11. The control slide 95 is fed by pressure medium lines, not shown, and controls the flow of oil to pressure medium outlets 96, 97. These lines 96, 97 lead into the cylinder bore 34 and each impacts one side of the piston 10 of the piston-cylinder unit 32. Since the mass of the control piston in the control slide 95 is very slight, the cam shaft 11 may also be very small and slender. In this way, all active forces can be greatly reduced and more rapid switching carried out. According to the design of the device, the control elements 33 and the control slide 95 may be combined, in a known manner, into one construction unit. In any case, a reduction of construction length is provided by the arrangement of the mechanical cam shaft 11 outside the longitudinal axis 60.

Having described a preferred embodiment of the invention, the following is claimed:

1. A linear drive with hydraulic amplification including a hydraulic cylinder which is integrated in a drive housing, a piston connected with a first screw drive which forms a mechanical return, a control valve arranged along the longitudinal axis of the first screw drive for the pressure medium, the control valve having a piston movable through a setting member, the setting member being connected at one end through a second screw drive with the first screw drive, and a setting drive acting on the setting member, with the distinction that the setting drive (9) has a movable element (35) and a translationally movable active element (10) for translationally moving the movable element (35) in the direction of the axis (60), the movable element (35) being connected with the setting member (17) and being movable with the latter in the direction of the axis (60) of the setting member (7), the setting member (7) being rotatable around the axis (60) independent of the setting drive (9), a lever (13) being fastened to the setting member (7), and being rotatable with it around the axis (60), and that on the drive housing is arranged a stop element (14) which can be adjusted in the range of rotation of the lever (13).

2. A linear drive with hydraulic amplification according to claim 1, with the distinction that the first screw drive (4) includes a spindle (19) and the second screw drive (8) is a ball threaded drive including a ball threaded spindle (29) arranged on one end of the setting member (7) and a nut (28) supported for rotation in the drive housing, said nut (28) receiving the end of the setting member (7) and being connected rigidly with the spindle (19) of the first screw drive (4).

3. A linear drive with hydraulic amplification according to claim 2, with the distinction that a double-acting piston-cylinder unit (32) is arranged on the setting member (7) as the setting drive (9), the unit (32) producing axial movements of the setting member (7).

4. A linear drive with hydraulic amplification according to claim 2, with the distinction that a cam shaft (11) acts as an auxiliary element for translationally moving the active element (10) of the setting drive (9) and that one end of the active element (10) lies over one turn of the cam shaft (11), at least in part, against the control surface of the cam shaft (11).

5. A linear drive with hydraulic amplification according to claim 4, with the distinction that between the cam shaft (11) and the end of the setting member (7) is installed an additional switching and control element (80) movable transverse to the axis, the switching and control element (80) lying by a running roller (81) against the control surface of the cam (12).

6. A linear drive with hydraulic amplification according to claim 5, with the distinction that parallel to a control element (33) is arranged a mechanically turned-on control slide (95), two pressure medium outlets (96, 97) of the control slide (95) discharging into a cylinder bore (34) and impacting a piston (10) of the double-acting piston-cylinder unit (32) with pressure medium, a mechanical switching element (98) of the control slide (95) cooperating with the switching and control element (80) and the cam shaft (11).

7. A linear drive with hydraulic amplification according to claim 1, with the distinction that, on the setting member (7) is arranged a spring (54) which acts in the axial direction opposite the linear screw-in movement produced by the second screw drive (8), the spring (54) being linked at one end to the setting member (7) and at the other end to a solid support (55).

8. A linear drive with hydraulic amplification according to claim 1, with the distinction that the setting member (7) and the piston connected with the first screw drive are connected to respective measuring devices (39, 43) for detecting corresponding positions of the setting member (7) and the piston in the axial direction.

9. A linear drive with hydraulic amplification according to claim 1, with the distinction that the stop element (14) can be adjusted through a toothed rack (50), at least one spring-weighted braking means (92) being arranged on the rack (50), the braking means (92) blocking the rack (50) in the position in which the lever (13) lies against the stop element (14), the braking means (92) being connected to a piston (90) and its piston chamber (93) with a pressure medium bore (24) to the cylinder bore (16).

10. A linear drive with hydraulic amplification according to claim 1, with the distinction that a piston rod is connected to the piston and is operatively connectable to a fuel injection pump of an internal combustion engine for driving the fuel injection pump.

11. A linear drive with hydraulic amplification according to claim 1, with the distinction that a piston rod is connected to the piston and is operatively connectable to inlet and outlet valves of an internal combustion engine for driving the inlet and outlet valves.

* * * * *

UNITED STATES PATENT AND TRADEMARK OFFICE

CERTIFICATE OF CORRECTION

PATENT NO. : 5,056,414

DATED : October 15, 1991

INVENTOR(S) : Peter Fuchs

It is certified that error appears in the above-identified patent and that said Letters Patent is hereby corrected as shown below:

Column 11, line 7, claim 1, change "(17)" to --(7)--.

Column 12, line 31, claim 9, delete "to" and insert --by--.

Signed and Sealed this

Second Day of March, 1993

*Attest:*

STEPHEN G. KUNIN

*Attesting Officer*

*Acting Commissioner of Patents and Trademarks*